US009063481B2

(12) United States Patent
Murakami et al.

(10) Patent No.: US 9,063,481 B2
(45) Date of Patent: Jun. 23, 2015

(54) FIXING DEVICE, IMAGE FORMING APPARATUS AND SURFACE RESTORATION METHOD

(71) Applicant: Konica Minolta Inc., Tokyo (JP)

(72) Inventors: Masanori Murakami, Aichi (JP); Tsutomu Sakamaki, Tokyo (JP); Toru Komatsu, Tokyo (JP)

(73) Assignee: KONICA MINOLTA, INC. (JP)

( * ) Notice: Subject to any disclaimer, the term of this patent is extended or adjusted under 35 U.S.C. 154(b) by 0 days.

(21) Appl. No.: 14/281,092

(22) Filed: May 19, 2014

(65) Prior Publication Data

US 2014/0348527 A1 Nov. 27, 2014

(30) Foreign Application Priority Data

May 24, 2013 (JP) ..... 2013-110059

(51) Int. Cl.
*G03G 15/20* (2006.01)

(52) U.S. Cl.
CPC ..... *G03G 15/2028* (2013.01); *G03G 15/2075* (2013.01)

(58) Field of Classification Search
CPC ..... G03G 15/2028; G03G 15/2075
See application file for complete search history.

(56) References Cited

U.S. PATENT DOCUMENTS

| | | | | |
|---|---|---|---|---|
| 7,653,321 | B2 | 1/2010 | Yoshikawa | |
| 2008/0038026 | A1* | 2/2008 | Ai et al. | 399/328 |
| 2008/0038027 | A1* | 2/2008 | Ito et al. | 399/328 |
| 2009/0297233 | A1* | 12/2009 | Kameda | 399/322 |
| 2012/0213539 | A1* | 8/2012 | Maruko | 399/67 |
| 2012/0251153 | A1* | 10/2012 | Takada | 399/68 |

FOREIGN PATENT DOCUMENTS

| | | | |
|---|---|---|---|
| JP | 2008-20790 | A | 1/2008 |
| JP | 2008-40010 | A | 2/2008 |
| JP | 2010-217466 | A | 9/2010 |

* cited by examiner

*Primary Examiner* — Sandra Brase
(74) *Attorney, Agent, or Firm* — Cantor Colburn LLP

(57) ABSTRACT

Disclosed herein is a fixing device including: a fixing nip width changing section configured to change a fixing nip width of a fixing nip; and a control section configured to control the fixing nip width changing section such that the fixing nip width is smaller than a fixing nip width for use in a fixation, and to rotate a fixing side member and a back side supporting member at different circumferential speeds so as to restore a surface of the fixing side member, wherein the control section controls the fixing nip width such that a circumferential speed difference between the fixing side member and the back side supporting member is equal to a predetermined circumferential speed difference.

15 Claims, 6 Drawing Sheets

| EVALUATION ITEM | FIXING NIP WIDTH OF FIXING NIP NP [mm] | | | | | | |
|---|---|---|---|---|---|---|---|
| | 6 | 7 | 8 | 9 | 10 | 11 | 12 |
| SURFACE RESTORATION OF FIXING BELT | B | B | A | A | A | A | B |
| ROTATION | B | B | A | A | A | A | A |

FIG. 5

FIXING DEVICE, IMAGE FORMING APPARATUS AND SURFACE RESTORATION METHOD

CROSS REFERENCE TO RELATED APPLICATIONS

This application is entitled and claims the benefit of Japanese Patent Application No. 2013-110059, filed on May 24, 2013, the disclosure of which including the specification, drawings and abstract is incorporated herein by reference in its entirety.

BACKGROUND OF THE INVENTION

1. Field of the Invention

The present invention relates to an electrophotographic type fixing device, an image forming apparatus and a surface restoration method.

2. Description of Related Art

In general, an electrophotographic image forming apparatus (such as a printer, a copy machine, and a fax machine) is configured to irradiate (expose) a charged photoconductor with (to) laser light based on image data to form an electrostatic latent image on the surface of the photoconductor. The electrostatic latent image is then visualized by supplying toner from a developing device to the photoconductor (image carrier) on which the electrostatic latent image is formed, whereby a toner image is formed. Further, the toner image is directly or indirectly transferred to a sheet, followed by heating and pressurization, whereby an image is formed on the sheet.

An example of the fixing device that fixes a toner image in the above-mentioned manner is a heat-fixing type fixing device that applies heat and pressure on a sheet on which a toner image has been transferred while passing the sheet through a fixing nip formed by a fixing side member such as a fixing roller or a fixing belt and by a back side supporting member such as a pressure roller or a pressing belt which is brought into pressure contact with the fixing side member.

There is known a problem that, when a thick sheet or a sheet having a rough surface is passed through the fixing nip, a sheet-edge mark is left on the surface of the fixing side member, at a position which makes contact with the both end portions of the sheet. When forming an image having an image forming range including the position where the sheet-edge mark is left, the fixing process is not uniformly performed in the sheet width direction because of the sheet-edge mark, resulting in gloss unevenness in the fixed image. To be more specific, the glossiness of the image which has been fixed at the position where the sheet-edge mark is left becomes lower than the glossiness of the image which is formed at the position where the sheet-edge mark is not left.

In order to solve the above-mentioned problem, Japanese Patent Application Laid-Open No. 2010-217466 discloses a technique in which, at a nip portion, a speed difference is provided between a fixing member (fixing side member) and a pressing member (back side supporting member), and the two members are brought into sliding contact with each other to thereby perform cleaning on the surfaces of the fixing side member and the back side supporting member.

In addition, Japanese Patent Application Laid-Open No. 2008-20790 discloses a technique in which a restoring section (refreshing roller) that restores the surface property of a fixing roller (fixing side member) to improve the fixing performance is provided.

However, with the technique of Japanese Patent Application Laid-Open No. 2010-217466, depending on the state of the fixing nip formed between the fixing side member and the back side supporting member, the surface of the fixing side member and the surface of the back side supporting member may not slip smoothly, and consequently the fixing side member and the back side supporting member may not be rotationally driven with the desired speed difference therebetween. In this case, since sufficient rubbing between the fixing side member and the back side supporting member is not achieved, the sheet-edge mark left on the fixing side member may not be removed, and gloss unevenness due to the sheet-edge mark may not be surely prevented.

With the technique disclosed in Japanese Patent Application Laid-Open No. 2008-20790, a dedicated device for restoring the surface property of the fixing side member has to be separately provided, and therefore the cost of the fixing device may be increased.

SUMMARY OF THE INVENTION

An object of the present invention is to provide a fixing device, an image forming apparatus and a surface restoration method which can remove a sheet-edge mark left on a fixing side member and can surely prevent gloss unevenness due to the sheet-edge mark from being caused, without increasing the cost.

To achieve at least one of the above-mentioned objects, a fixing device reflecting one aspect of the present invention includes: a fixing side member disposed on a fixing side of a sheet on which a toner image is formed; a back side supporting member configured to form a fixing nip for conveying the sheet in a tightly sandwiching manner in a state where the back side supporting member is brought in pressure contact with the fixing side member; a fixing nip width changing section configured to change a fixing nip width of the fixing nip; and a control section configured to control the fixing nip width changing section such that the fixing nip width is smaller than a fixing nip width for use in a fixation, and to rotate the fixing side member and the back side supporting member at different circumferential speeds so as to restore a surface of the fixing side member, wherein the control section controls the fixing nip width such that a circumferential speed difference between the fixing side member and the back side supporting member is equal to a predetermined circumferential speed difference.

Desirably, in the fixing device, the fixing side member rotates to follow a rotation of the back side supporting member, the fixing device further comprises a braking torque generation section configured to generate braking torque for limiting the following rotation of the fixing side member, and the control section rotationally drives the back side supporting member and controls the braking torque generation section to generate the braking torque so that the fixing side member and the back side supporting member rotate at different circumferential speeds.

Desirably, in the fixing device, the control section sets a period for which the fixing side member and the back side supporting member are rotated on the basis of the fixing nip width.

Desirably, in the fixing device, the control section sets a period for which the fixing side member and the back side supporting member are rotated to 1 minute to 90 minutes.

Desirably, in the fixing device, when a process of restoring the surface of the fixing side member is performed, the control section controls a temperature of the fixing side member at a predetermined temperature which is set in advance.

Desirably, in the fixing device, the control section performs a process of restoring the surface of the fixing side member at a time when a width of the sheet for fixing is increased from a present moment.

Desirably, in the fixing device, the fixing side member is a fixing belt.

To achieve the abovementioned object, an image forming apparatus which reflects one aspect of the present invention includes the fixing device.

To achieve at least one of the above-mentioned objects, in a surface restoration method of restoring a surface of a fixing side member in a fixing device which reflects one aspect of the present invention, the fixing device includes a fixing side member disposed on a fixing side of a sheet on which a toner image is formed, and a back side supporting member configured to form a fixing nip for conveying the sheet in a tightly sandwiching manner in a state where the back side supporting member is brought in pressure contact with the fixing side member, and the method reflecting one aspect of the present invention includes: changing a fixing nip width of the fixing nip such that the fixing nip width is smaller than a fixing nip width for use in a fixation; and rotating the fixing side member and the back side supporting member at different circumferential speeds, wherein the fixing nip width is controlled such that a circumferential speed difference between the fixing side member and the back side supporting member is equal to a predetermined circumferential speed difference.

Desirably, in the surface restoration method, the fixing side member rotates to follow a rotation of the back side supporting member, and the back side supporting member is rotationally driven and braking torque for limiting the following rotation of the fixing side member is generated so that the fixing side member and the back side supporting member rotate at different circumferential speeds.

Desirably, in the surface restoration method, a period for which the fixing side member and the back side supporting member are rotated is set on the basis of the fixing nip width.

Desirably, in the surface restoration method, a period for which the fixing side member and the back side supporting member are rotated is set to 1 minute to 90 minutes.

Desirably, in the surface restoration method, when a process of restoring the surface of the fixing side member is performed, a temperature of the fixing side member is controlled at a predetermined temperature which is set in advance.

Desirably, in the surface restoration method, a process of restoring the surface of the fixing side member is performed at a time when a width of the sheet for fixing is increased from a present moment.

Desirably, in the surface restoration method, the fixing side member is a fixing belt.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein:

FIG. 5 illustrates the relationship between a fixing nip width of a fixing nip and a surface restoration of a fixing belt in the embodiment.

DESCRIPTION OF THE PREFERRED EMBODIMENTS

In the following, a present embodiment is described in detail with reference to the accompanying drawings.

[Configuration of Image Forming Apparatus 1]

Figure 1:
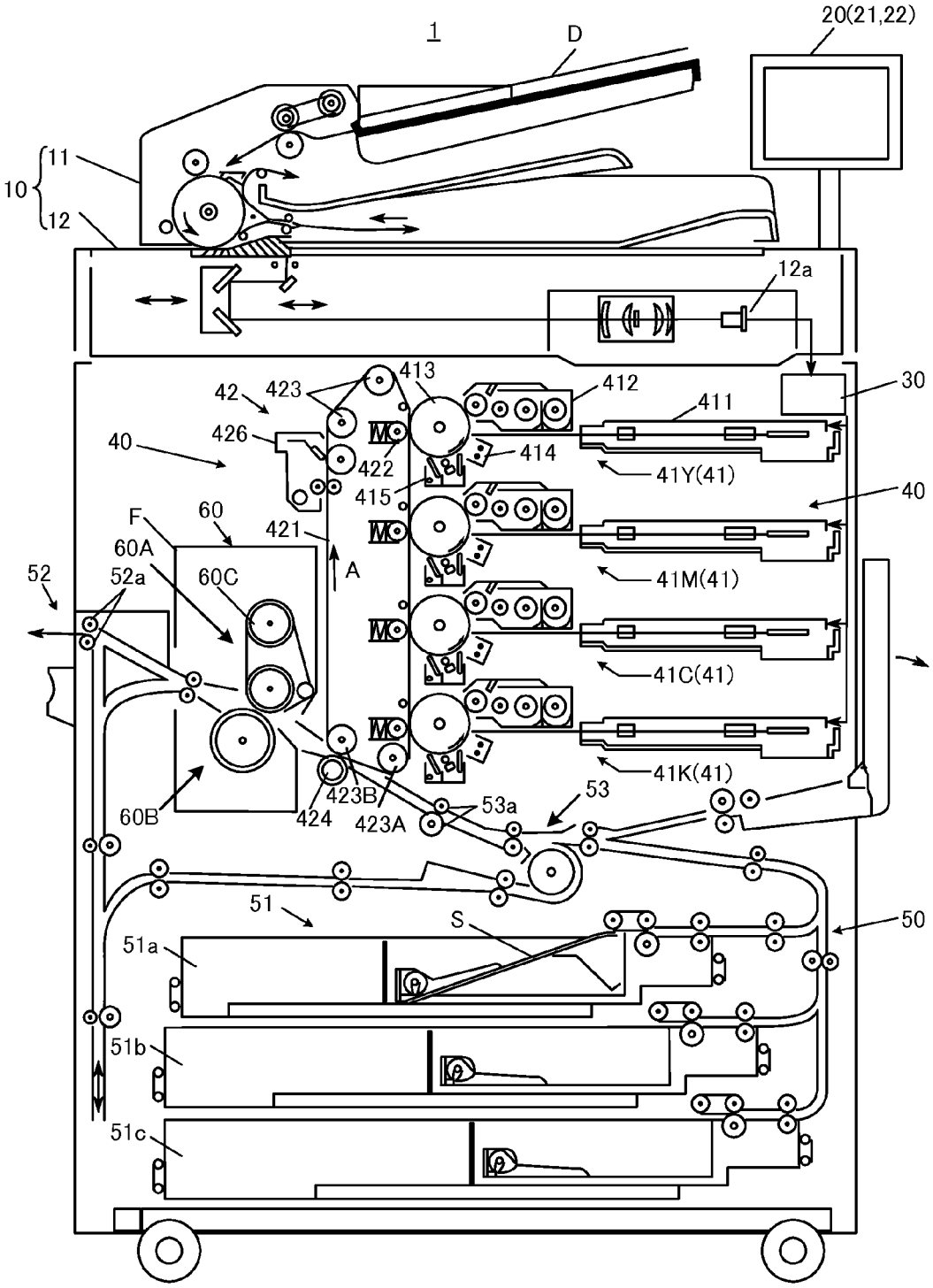
FIG. 1 is a schematic view illustrating a general configuration of an image forming apparatus of an embodiment.
Figure 2:
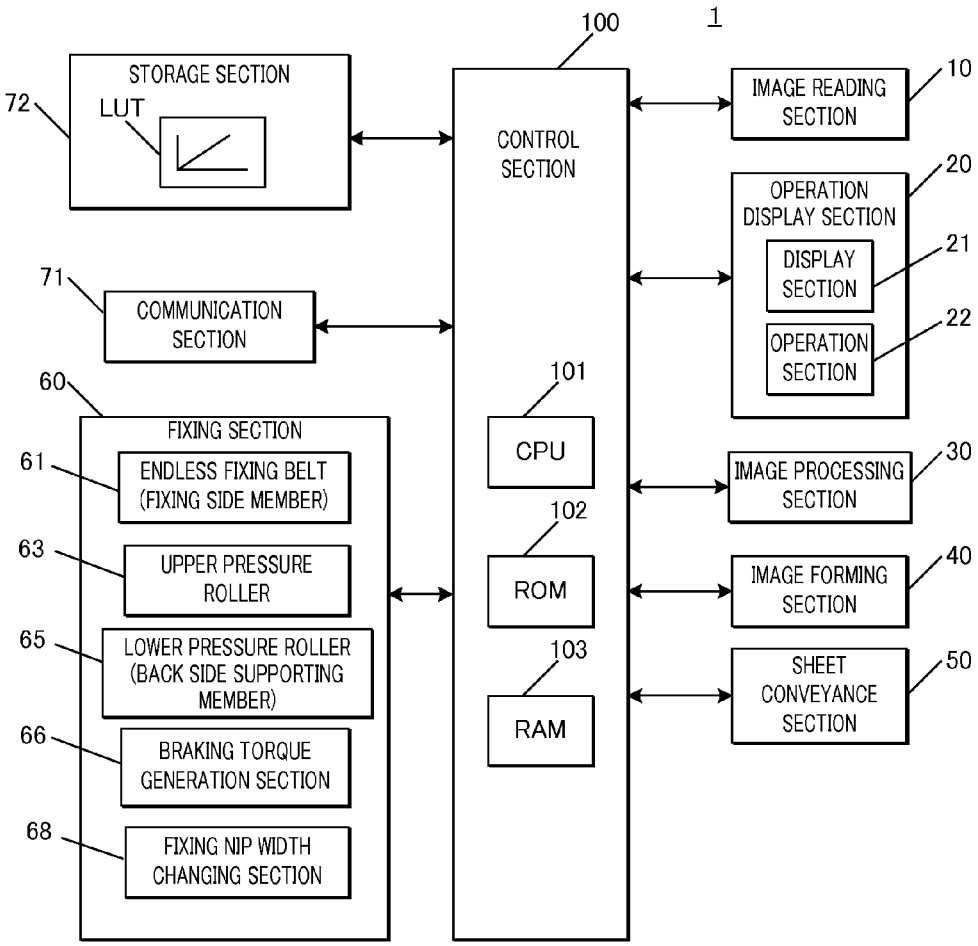
FIG. 2 illustrates a main part of a control system of the image forming apparatus of the embodiment.

FIG. 1 is a schematic view illustrating a general configuration of image forming apparatus 1 according to an embodiment of the present invention. FIG. 2 illustrates a main part of a control system of image forming apparatus 1 according to the present embodiment. Image forming apparatus 1 illustrated in FIGS. 1 and 2 is an intermediate-transfer type color-image forming apparatus utilizing electrophotographic process technology. Specifically, image forming apparatus 1 transfers (primary-transfers) toner images of yellow (Y), magenta (M), cyan (C), and black (K) formed on photoconductor drums 413 to intermediate transfer belt 421, and superimposes the toner images of the four colors on one another on intermediate transfer belt 421. Then, image forming apparatus 1 transfers (secondary-transfers) the resultant image to sheet S, to thereby form an image.

In addition, image forming apparatus 1 employs a tandem system in which photoconductor drums 413 corresponding to four colors of YMCK are disposed in series in the travelling direction of intermediate transfer belt 421, and toner images of the colors are sequentially transferred to intermediate transfer belt 421 in one procedure.

As illustrated in FIG. 2, image forming apparatus 1 includes image reading section 10, operation display section 20, image processing section 30, image forming section 40, sheet conveyance section 50, fixing section 60, and control section 100.

Control section 100 includes central processing unit (CPU) 101, read only memory (ROM) 102, random access memory (RAM) 103 and the like. CPU 101 reads a program suited to processing contents out of ROM 102, develops the program in RAM 103, and integrally controls an operation of each block of image forming apparatus 1 in cooperation with the developed program. At this time, CPU 101 refers to various kinds of data stored in storage section 72. Storage section 72 is composed of, for example, a non-volatile semiconductor memory (so-called flash memory) or a hard disk drive.

Control section 100 transmits and receives various data to and from an external apparatus (for example, a personal computer) connected to a communication network such as a local area network (LAN) or a wide area network (WAN), through communication section 71. Control section 100 receives, for example, image data transmitted from the external apparatus, and performs control to form an image on sheet S on the basis of the image data (input image data). Communication section 71 is composed of, for example, a communication control card such as a LAN card.

Image reading section 10 includes auto document feeder (ADF) 11, document image scanner (scanner) 12, and the like.

Auto document feeder 11 causes a conveyance mechanism to feed document D placed on a document tray, and sends out document D to document image scanner 12. Auto document feeder 11 enables images (even both sides thereof) of a large number of documents D placed on the document tray to be successively read at once.

Document image scanner 12 optically scans a document fed from auto document feeder 11 to its contact glass or a document placed on its contact glass, and images light reflected from the document on the light receiving surface of charge coupled device (CCD) sensor 12*a*, to thereby read the document image. Image reading section 10 generates input image data on the basis of a reading result provided by document image scanner 12. Image processing section 30 performs predetermined image processing on the input image data.

Operation display section 20 includes, for example, a liquid crystal display (LCD) with a touch panel, and functions as display section 21 and operation section 22. Display section 21 displays various operation screens, image conditions, the operating conditions of each function, and the like in accordance with display control signals received from control section 100. Operation section 22 includes various operation keys such as a numeric keypad and a start key, receives various input operations performed by a user, and outputs operation signals to control section 100.

Image processing section 30 includes a circuit that performs digital image processing suited to initial settings or user settings, on the input image data, and the like. For example, image processing section 30 performs tone correction on the basis of tone correction data (tone correction table), under the control of control section 100. In addition to the tone correction, image processing section 30 also performs various correction processes such as color correction and shading correction as well as a compression process, on the input image data. Image forming section 40 is controlled on the basis of the image data that has been subjected to these processes.

Image forming section 40 includes: image forming units 41Y, 41M, 41C, and 41K for images of colored toners respectively containing a Y component, an M component, a C component, and a K component on the basis of the input image data; intermediate transfer unit 42 and the like.

Image forming units 41Y, 41M, 41C, and 41K for the Y component, the M component, the C component, and the K component have a similar configuration. For ease of illustration and description, common elements are denoted by the same reference signs. Only when elements are need to be discriminated from one another, Y, M, C, or K is added to their reference signs. In FIG. 1, reference signs are given to only the elements of image forming unit 41Y for the Y component, and reference signs are omitted for the elements of other image forming units 41M, 41C, and 41K.

Image forming unit 41 includes exposure device 411, developing device 412, photoconductor drums 413, charging device 414, drum cleaning device 415 and the like.

Photoconductor drums 413 are, for example, negative-charge-type organic photoconductor (OPC) formed by sequentially laminating an under coat layer (UCL), a charge generation layer (CGL), and a charge transport layer (CTL) on the circumferential surface of a conductive cylindrical body (aluminum-elementary tube) which is made of aluminum and has a diameter of 80 [mm]. The charge generation layer is made of an organic semiconductor in which a charge generating material (for example, phthalocyanine pigment) is dispersed in a resin binder (for example, polycarbonate), and generates a pair of positive charge and negative charge through exposure to light by exposure device 411. The charge transport layer is made of a layer in which a hole transport material (electron-donating nitrogen compound) is dispersed in a resin binder (for example, polycarbonate resin), and transports the positive charge generated in the charge generation layer to the surface of the charge transport layer.

Control section 100 controls a driving current supplied to a driving motor (not shown in the drawings) that rotates photoconductor drums 413, whereby photoconductor drums 413 is rotated at a constant circumferential speed.

Charging device 414 evenly negatively charges the surface of photoconductor drums 413. Exposure device 411 is composed of, for example, a semiconductor laser, and configured to irradiate photoconductor drums 413 with laser light corresponding to the image of each color component. Since the positive charge is generated in the charge generation layer of photoconductor drums 413 and is transported to the surface of the charge transport layer, the surface charge (negative charge) of photoconductor drums 413 is neutralized. An electrostatic latent image of each color component is formed on the surface of photoconductor drums 413 due to a difference in potential from its surroundings.

Developing device 412 is, for example, a two-component development type developing device, and attaches the toners of respective color components to the surface of photoconductor drums 413 to visualize the electrostatic latent image, thereby forming a toner image.

Drum cleaning device 415 includes a drum cleaning blade that is brought into sliding contact with the surface of photoconductor drums 413, and removes residual toner that remains on the surface of photoconductor drums 413 after the primary transfer.

Intermediate transfer unit 42 includes intermediate transfer belt 421, primary transfer rollers 422, a plurality of support rollers 423, secondary transfer roller 424, belt cleaning device 426 and the like.

Intermediate transfer belt 421 is composed of an endless belt, and is stretched around the plurality of support rollers 423 in a loop form. At least one of the plurality of support rollers 423 is composed of a driving roller, and the other rollers are each composed of a driven roller. Preferably, for example, roller 423A disposed on the downstream side in the belt travelling direction relative to primary transfer rollers 422 for K-component is a driving roller. With this configuration, the travelling speed of the belt at a primary transfer section can be easily maintained at a constant speed. When driving roller 423A rotates, intermediate transfer belt 421 travels in an arrow A direction at a constant speed.

Primary transfer rollers 422 are disposed to face photoconductor drums 413 of respective color components, on the inner periphery side of intermediate transfer belt 421. Primary transfer rollers 422 are brought into pressure contact with photoconductor drums 413 with intermediate transfer belt 421 therebetween, whereby a primary transfer nip for transferring a toner image from photoconductor drums 413 to intermediate transfer belt 421 is formed.

Secondary transfer roller 424 is disposed to face roller 423B (hereinafter referred to as "backup roller 423B") disposed on the downstream side in the belt travelling direction relative to driving roller 423A, on the outer peripheral surface side of intermediate transfer belt 421. Secondary transfer roller 424 is brought into pressure contact with backup roller 423B with intermediate transfer belt 421 therebetween, whereby a secondary transfer nip for transferring a toner image from intermediate transfer belt 421 to sheet S is formed.

When intermediate transfer belt 421 passes through the primary transfer nip, the toner images on photoconductor drums 413 are sequentially primary-transferred to intermediate transfer belt 421. To be more specific, a primary transfer bias is applied to primary transfer rollers 422, and electric charge of the polarity opposite to the polarity of the toner is applied to the rear side (the side that makes contact with primary transfer rollers 422) of intermediate transfer belt 421, whereby the toner image is electrostatically transferred to intermediate transfer belt 421.

Thereafter, when sheet S passes through the secondary transfer nip, the toner image on intermediate transfer belt 421 is secondary-transferred to sheet S. To be more specific, a secondary transfer bias is applied to secondary transfer roller 424, and electric charge of the polarity opposite to the polarity of the toner is applied to the rear side (the side that makes contact with secondary transfer roller 424) of sheet S, whereby the toner image is electrostatically transferred to sheet S. Sheet S on which the toner image has been transferred is conveyed toward fixing section 60.

Belt cleaning device 426 includes a belt cleaning blade that is brought into sliding contact with the surface of intermediate transfer belt 421, and removes residual toner that remains on the surface of intermediate transfer belt 421 after the secondary transfer. Alternatively, it is also possible to adopt a configuration (so-called belt-type secondary transfer unit) in which a secondary transfer belt is installed in a stretched state in a loop form around a plurality of support rollers including a secondary transfer roller.

Fixing section 60 includes upper fixing section 60A having a fixing side member disposed on a fixing surface (the surface on which a toner image is formed) of sheet S, lower fixing section 60B having a back side supporting member disposed on the rear surface (the surface opposite to the fixing surface) side of sheet S, heating source 60C, and the like. Back side supporting member is brought into pressure contact with the fixing side member, whereby a fixing nip for conveying sheet S in a tightly sandwiching manner is formed.

Fixing section 60 applies, at the fixing nip, heat and pressure to sheet S on which a toner image has been secondary-transferred, thereby fixing the toner image on sheet S. Fixing section 60 is disposed as a unit in fixing part F. In addition, fixing part F may be provided with an air-separating unit that blows air to separate sheet S from the fixing side member or the back side supporting member. Fixing section 60 will be described in detail later.

Sheet conveyance section 50 includes sheet feeding section 51, ejection section 52, conveyance path section 53 and the like. Three sheet feed tray units 51*a* to 51*c* included in sheet feeding section 51 store sheets S (standard sheets, special sheets) discriminated on the basis of the basis weight, the size, and the like, for each type set in advance. Conveyance path section 53 includes a plurality of pairs of conveyance rollers such as a pair of registration rollers 53*a*.

The recording sheets S stored in sheet tray units 51*a* to 51*c* are output one by one from the uppermost, and conveyed to image forming section 40 by conveyance path section 53. At this time, the registration roller section in which the pair of registration rollers 53*a* are arranged corrects skew of sheet S fed thereto, and the conveyance timing is adjusted. Then, in image forming section 40, the toner image on intermediate transfer belt 421 is secondary-transferred to one side of sheet S at one time, and a fixing process is performed in fixing section 60. Sheet S on which an image has been formed is ejected out of the image forming apparatus by ejection section 52 including sheet discharging roller 52*a*.

[Configuration of Fixing Section 60]

Figure 3:
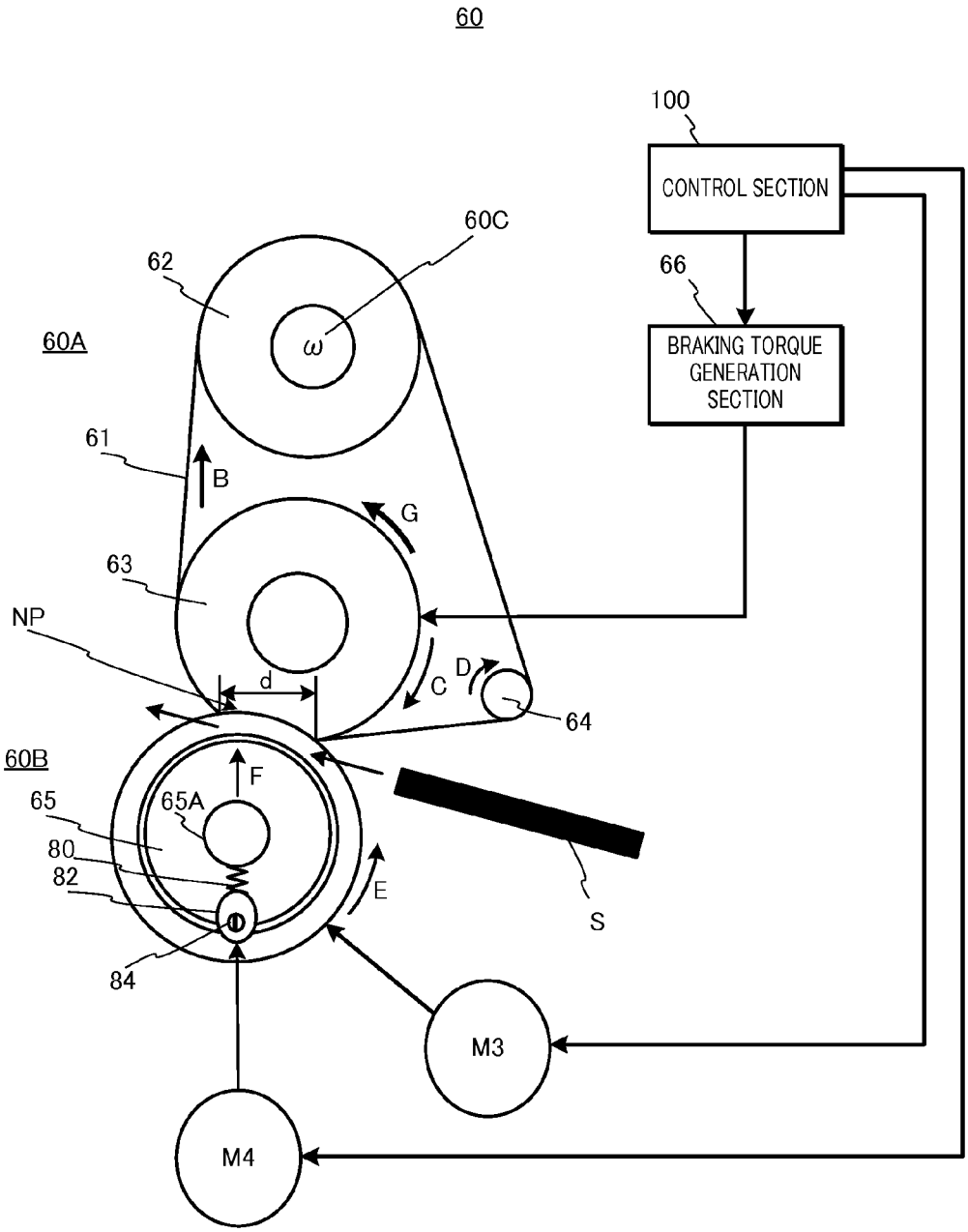
FIG. 3 is a schematic view illustrating a configuration of a fixing section of the image forming apparatus of the embodiment.

Next, with reference to FIG. 3, the configuration of fixing section 60 will be described. FIG. 3 is a schematic view illustrating the configuration of fixing section 60.

It is to be noted that fixing section 60 and control section 100 function as a fixing device. Fixing section 60 and control section 100 may be configured as a unit attached to image forming apparatus 1, or may be separately incorporated in image forming apparatus 1 so as to function as a fixing device.

Upper fixing section 60A includes endless fixing belt 61, heating roller 62, upper pressure roller 63 and stretching member 64, which serve as a fixing side member (belt heating system). Fixing belt 61 is installed in a stretched state around heating roller 62, upper pressure roller 63, and stretching member 64 at a predetermined belt tensile force (for example, 400 [N]).

Fixing belt 61 has an outer diameter of 120 [mm], and has a configuration in which the outer peripheral surface of a 70 [μm]-thick base member made of PI (polyimide), for example, is covered by 200 [μm]-thick heat-resistant silicon rubber (hardness JIS-A30[°]) serving as an elastic layer, and further, the surface layer is covered or coated with a 30 [μm]-thick tube made of PFA (perfluoro alkoxy), which is a heat-resistant resin. Together with lower pressure roller 65, fixing belt 61 forms fixing nip NP.

Fixing belt 61 makes contact with sheet S on which a toner image is formed, and thermally fixes the toner image on sheet S at a fixation temperature (for example, 160 to 200[° C.]). The fixing temperature is a temperature at which a heat energy required for melting the toner on sheet S can be obtained, and the fixing temperature differs depending on factors such as the type of sheet S on which an image is to be formed.

Heating roller 62 applies heat to fixing belt 61. Heating roller 62 is provided therein with heating source 60C (halogen heater) for applying heat to fixing belt 61. Heating roller 62 has an outer diameter of 58 [mm], and has a configuration in which the outer peripheral surface of a cylindrical mandrel made of aluminum or the like is coated with a resin layer of PTFE, for example.

The temperature of heating source 60C is controlled by control section 100. Heating source 60C applies heat to heating roller 62, and as a result, fixing belt 61 is heated.

Upper pressure roller 63 has an outer diameter of 70 [mm], and has a configuration in which a solid mandrel made of metal such as iron is covered with 20 [mm]-thick heat-resistant silicone rubber (hardness: Asker-C35 [°]) as an elastic layer, and is further coated with a 5 to 30 [μm]-thick resin layer of PTFE, which is low frictional and heat-resistant resin.

Upper pressure roller 63 is brought into pressure contact with lower pressure roller 65, which is rotated by a main driving source (motor M3) in fixing section 60, with fixing belt 61 therebetween. Upper pressure roller 63 is connected to braking torque generation section 66. Under the control of control section 100, braking torque generation section 66 generates braking torque along arrow G. Braking torque generation section 66 is composed of a brake (for example, a braking device utilizing a motor) that decreases the circumferential speed of upper pressure roller 63 and fixing belt 61 by mechanically controlling the following rotation of upper pressure roller 63, for example.

Lower fixing section 60B includes, for example, lower pressure roller 65 serving as a back side supporting member (roller pressing type). Lower pressure roller 65 has an outer diameter of 70 [mm], and has a configuration in which the outer peripheral surface of a cylindrical mandrel made of aluminum or the like is covered with 1 to 3 [mm]-thick heat-resistant silicon rubber (hardness: JIS-A30[°]) as an elastic layer, and is further covered with a 30 to 100 [μm]-thick resin layer of a PFA tube.

Under the control of control section 100, drive motor M3 rotates lower pressure roller 65 along an arrow E direction (counterclockwise direction). The driving control of drive motor M3 (for example, on/off of the rotation, the circumferential speed, and the like) is performed by control section 100. The circumferential speed of lower pressure roller 65 is, for example, 460 [mm/s].

Lower pressure roller 65 is provided therein with a heating source (not illustrated) such as a halogenheater or the like. When heat is generated by this heating source, lower pressure roller 65 is heated. Control section 100 controls the power to be supplied to the heating source, so as to control the temperature of lower pressure roller 65 at a predetermined temperature (for example, 80 to 120[° C.]).

Rotational shaft end 65A of lower pressure roller 65 is connected to drive motor M4 through pressing spring 80 and rotatable slide cum 82. Under the control of control section 100, drive motor M4 rotates slide cum 82 about shaft 84. When slide cum 82 is rotated by drive motor M4, pressing spring 80 biases lower pressure roller 65 along an arrow F direction. In accordance with the rotational position of slide cum 82, lower pressure roller 65 is brought into pressure contact with or separated from fixing belt 61. When lower pressure roller 65 is in pressure contact with fixing belt 61, the pressing amount of lower pressure roller 65 into the elastic layer of upper pressure roller 63 with fixing belt 61 therebetween is changed in accordance with the rotational position of slide cum 82. Thus, fixing nip width d of fixing nip NP formed between fixing belt 61 and lower pressure roller 65, that is, the length of fixing nip NP along the conveyance direction of sheet S is changed. To be more specific, fixing nip width d of fixing nip NP is increased as the pressing amount of lower pressure roller 65 into the elastic layer of upper pressure roller 63 is increased, while fixing nip width d of fixing nip NP is decreased as the pressing amount of lower pressure roller 65 into the elastic layer is decreased.

That is, drive motor M4, slide cum 82, and pressing spring 80 function as a fixing nip width changing section 68 that changes the fixing nip width of fixing nip NP.

Fixing nip width changing section 68 brings lower pressure roller 65 into pressure contact with upper pressure roller 63 with fixing belt 61 therebetween at a predetermined fixing load (for example, 2650 [N]). Thus, fixing nip NP for conveying sheet S in a tightly sandwiching manner is formed between fixing belt 61 and lower pressure roller 65.

When lower pressure roller 65 is rotated in an arrow E direction, fixing belt 61 rotates in an arrow B direction (clockwise direction) to follow the rotation of lower pressure roller 65. Along with this rotation, upper pressure roller 63 is rotated in an arrow C direction (clockwise direction). During the fixation process, braking torque generation section 66 does not operate, and the circumferential speed of fixing belt 61 is the same as the circumferential speed of lower pressure roller 65 (for example 460 [mm/s]). On the other hand, during the surface restoration process of fixing belt 61, braking torque generation section 66 limits the following rotation of upper pressure roller 63 and fixing belt 61, and fixing belt 61 rotates at a circumferential speed lower than that of lower pressure roller 65. That is, a circumferential speed difference is caused between fixing belt 61 and lower pressure roller 65. In the present embodiment, control section 100 controls braking torque generation section 66 to set the magnitude of the braking torque in accordance with the circumferential speed difference to be provided between fixing belt 61 and lower pressure roller 65. The circumferential speed difference can be increased by increasing the braking torque, and can be decreased by decreasing the braking torque.

As described above, when a thick sheet or sheet S having a rough surface is passed through fixing nip NP, a sheet-edge mark is left on the surface of the fixing side member at a position which makes contact with the both end portions of the sheet. When forming an image having an image forming range including the position where the sheet-edge mark is left, the fixing process is not uniformly performed in the sheet width direction because of the sheet-edge mark, resulting in gloss unevenness in the fixed image.

In order to solve this problem, there is known a technique in which a circumferential speed difference is provided between fixing belt 61 and lower pressure roller 65 when they are rotationally driven such that they are brought into sliding contact with each other for restoration of the surface of fixing belt 61 on which a sheet-edge mark has been left. Even when this technique is applied, however, depending on the state of fixing nip NP formed between fixing belt 61 and lower pressure roller 65, the surface of fixing belt 61 and the surface of lower pressure roller 65 may not slip smoothly, and consequently fixing belt 61 and lower pressure roller 65 may not be rotationally driven with the desired speed difference therebetween. In this case, since sufficient rubbing between fixing belt 61 and lower pressure roller 65 is not achieved, the sheet-edge mark left on fixing belt 61 may not be removed, and gloss unevenness due to the sheet-edge mark may not be surely prevented.

In order to solve this problem, in the present embodiment, control section 100 controls fixing nip width changing section 68 such that the fixing nip width of fixing nip NP is decreased in comparison with the fixing nip width for use in fixation of sheet S. In this state, control section 100 rotationally drives fixing belt 61 and lower pressure roller 65 with a circumferential speed difference such that they are brought into sliding contact with each other. Since the fixing nip width of fixing nip NP is decreased in comparison with the fixing nip width for use in the fixation process, the surface of fixing belt 61 and the surface of lower pressure roller 65 smoothly slip on each other, and thus it is possible to provide a desired speed difference between fixing belt 61 and lower pressure roller 65 at the time of rotationally driving fixing belt 61 and lower pressure roller 65. Thus, fixing belt 61 and lower pressure roller 65 can be sufficiently brought into sliding contact with each other, and the sheet-edge mark left on fixing belt 61 can be sufficiently removed for restoration. Accordingly, it is possible to surely prevent the situation where, when forming an image having an image forming range including the position where the sheet-edge mark is left, the fixing process is not uniformly performed in the sheet width direction because of the sheet-edge mark and gloss unevenness in the fixed image is caused.

[Surface Restoration Process of Image Forming Apparatus 1]

Figure 4:
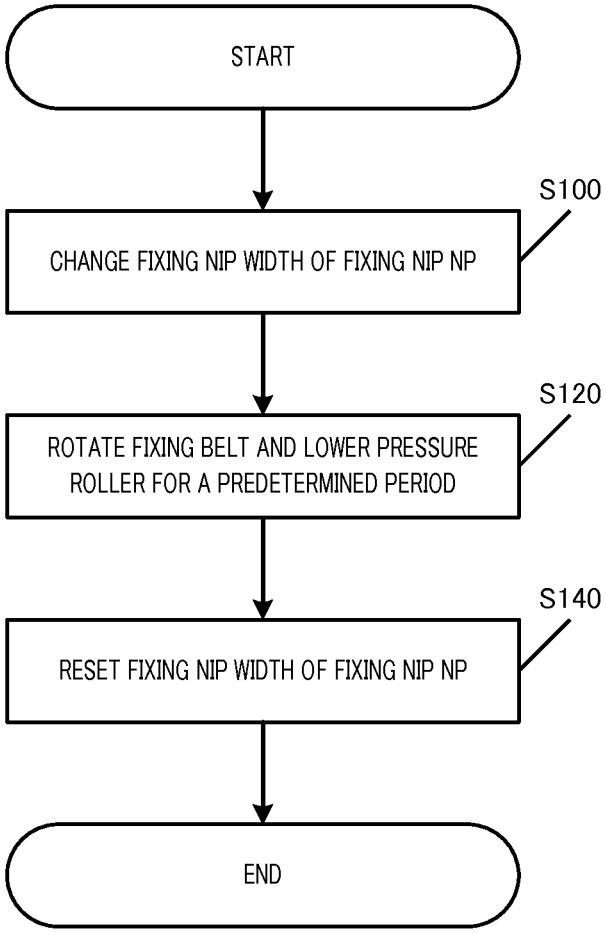
FIG. 4 is a flowchart of a surface restoration process of the image forming apparatus of the embodiment.

Next, with reference to the flowchart of FIG. 4, the surface restoration process of image forming apparatus 1 of the present embodiment will be described. It is to be noted that the surface restoration process illustrated in FIG. 4 is performed at a time when the sheet width, or the image forming range, of sheet S for fixing is increased from a present moment, for example.

First, control section 100 controls fixing nip width changing section 68 such that the fixing nip width of fixing nip NP is decreased in comparison with the fixing nip width for use in the fixation process (for example, 23 to 24 [mm]) (step S100). In the present embodiment, the fixing nip width of fixing nip NP is changed to about ½ to ⅓ of the fixing nip width for use in the fixation process (for example, 8 to 11 [mm]) Thus, the surface of fixing belt 61 and the surface of lower pressure roller 65 smoothly slip on each other.

Next, control section 100 provides a circumferential speed difference (for example, 5 to 50 [mm/s], which corresponds to 1 to 10[%] of the linear velocity of lower pressure roller 65) between fixing belt 61 and lower pressure roller 65, and rotationally drives fixing belt 61 and lower pressure roller 65 for a predetermined period (for example, 3 [min]) (step S120). In the present embodiment, with lower pressure roller 65 rotationally driven, control section 100 controls braking torque generation section 66 to generate braking torque that limits the rotation of fixing belt 61 that rotates to follow the rotation of lower pressure roller 65. Thus, the circumferential speed of fixing belt 61 is decreased to a speed lower than that of lower pressure roller 65. That is, fixing belt 61 and lower pressure roller 65 can be rotated at different circumferential speeds.

The period for the surface restoration process (the period for which fixing belt 61 and lower pressure roller 65 are rotationally driven) is set in accordance with the fixing nip width. That is, as the fixing nip width is increased, the frictional force between fixing belt 61 and lower pressure roller 65 is increased and it becomes more difficult to provide a speed difference between them, and therefore, the period for the surface restoration is required to be prolonged. Further, in view of surely achieving the effect of the surface restoration process while taking into account the durability of fixing belt 61 and lower pressure roller 65, the period for which fixing belt 61 and lower pressure roller 65 are rotationally driven is preferably set within a range of 1 minute to 90 minutes. Although described later in the Example, the period for which driving fixing belt 61 and lower pressure roller 65 are rotationally driven is preferably set to 3 [min].

In addition, it is preferable to control the temperature of fixing belt 61 at a predetermined temperature set in advance (80 to 230[° C.]) when fixing belt 61 and lower pressure roller 65 are rotationally driven. One reason for this is that, when the temperature of fixing belt 61 is lower than 80[° C.], toner waste or the like remaining on fixing belt 61 and lower pressure roller 65 is not softened, and the rubbing between fixing belt 61 and lower pressure roller 65 may leave a mark on the surface of fixing belt 61 and the surface of lower pressure roller 65. Another reason is that, when the temperature of fixing belt 61 is lower than 80[° C.], the diameter of the elastic layer of upper pressure roller 63 is decreased. That is, the pressing amount of lower pressure roller 65 into the elastic layer of upper pressure roller 63 is decreased and consequently the fixing nip width of fixing nip NP is decreased. Thus, the slipping between the surface of fixing belt 61 and the surface of lower pressure roller 65 becomes excessive, and a scratch may be left on the surface of fixing belt 61. Given that the upper temperature limit of the silicon rubber composing fixing belt 61 and lower pressure roller 65 is 230[° C.], the upper limit of the predetermined temperature of fixing belt 61 is set to 230[° C.].

As described later in Example, the predetermined temperature for restoring the surface of fixing belt 61 is preferably the same as the predetermined temperature for the fixation process (fixation temperature) (for example, 180[° C.]). This advantageously makes it unnecessary to change the temperature of fixing belt 61 when the processing is transferred to a normal print operation after the surface restoration process has been executed. It is to be noted that a protector is preferably provided in the form of software so as to prevent the surface restoration process from being started when the temperature of fixing belt 61 is lower than 80[° C.].

In addition, at the time of rotationally driving fixing belt 61 and lower pressure roller 65, lower pressure roller 65 is preferably operated while being cooled down to about 80 to 120[° C.] by, for example, a cooling fan or the like. Since the surface restoration process is performed in the state where fixing belt 61 and lower pressure roller 65 are in pressure contact with each other, the surface temperature of lower pressure roller 65 is increased in the process. When a normal print operation is performed on sheet S (for example, a coated sheet) in the state where the surface temperature of lower pressure roller 65 is increased, a blister is caused due to excessive heating of sheet S. In order to prevent the blister from being caused, it is necessary to maintain the surface temperature of lower pressure roller 65 at about 80 to 120[° C.] during the typical print operation. Maintaining the surface temperature of lower pressure roller 65 at about 80 to 120[° C.] during the surface restoration process provides an effect of shortening the transition time to normal print mode after the surface restoration process.

Finally, control section 100 controls fixing nip width changing section 68 such that the fixing nip width changed at step S100 is reset to the fixing nip width for use in fixation of sheet S (step S140). Upon completion of the process of step S140, image forming apparatus 1 terminates the processing of FIG. 4.

Effect of Present Embodiment

As has been described in detail, the present embodiment includes: fixing belt 61 disposed on a fixing side of sheet S on which a toner image is formed; lower pressure roller 65 configured to form fixing nip NP for conveying sheet S in a tightly sandwiching manner in a state where lower pressure roller 65 is brought in pressure contact with fixing belt 61; fixing nip width changing section 68 configured to change a fixing nip width of fixing nip NP; and control section 100 configured to control fixing nip width changing section 68 such that the fixing nip width is smaller than a fixing nip width for use in a fixation, and to rotate fixing belt 61 and lower pressure roller 65 at different circumferential speeds so as to restore a surface of fixing belt 61.

According to the present embodiment having the above-mentioned configuration, when the process of restoring the surface of fixing belt 61 is performed, the surface of fixing belt 61 and the surface of lower pressure roller 65 smoothly slip on each other unlike in the fixation process during which the surface of fixing belt 61 and the surface of lower pressure roller 65 may not slip smoothly, and therefore it is possible to rotationally drive fixing belt 61 and lower pressure roller 65 with a desired speed difference therebetween. Consequently, fixing belt 61 and lower pressure roller 65 can be sufficiently brought into sliding contact with each other, and the sheet-edge mark left on fixing belt 61 can be sufficiently removed for restoration. Thus, it is possible to surely prevent the situation where, when forming an image having an image forming range including the position where the sheet-edge mark is left, the fixing process is not uniformly performed in the sheet width direction because of the sheet-edge mark and gloss unevenness in the fixed image is caused. In addition, since it is not necessary to newly provide a dedicated device that removes the sheet-edge mark left on the surface of fixing belt 61, the cost of the fixing device is not increased. Thus, without increasing the cost, the sheet-edge mark left on fixing belt 61 can be removed, and the gloss unevenness due to the sheet-edge mark can be surely prevented from being caused.

[Modification]

In the above-mentioned embodiment, fixing belt 61 follows lower pressure roller 65, and braking torque for limiting the following rotation of fixing belt 61 is generated, whereby fixing belt 61 and lower pressure roller 65 are rotated at different circumferential speeds. However, the present invention is not limited thereto. For example, it is also possible to adopt a configuration where lower pressure roller 65 rotates to follow the rotation of fixing belt 61. In this case, by generating the braking torque for limiting the following rotation of lower pressure roller 65 with fixing belt 61 rotationally driven, fixing belt 61 and lower pressure roller 65 can be rotated at different circumferential speeds. Alternatively, it is also possible to adopt a configuration where fixing belt 61 and lower pressure roller 65 are separately rotationally driven, and provide a circumferential speed difference between fixing belt 61 and lower pressure roller 65 so that fixing belt 61 and lower pressure roller 65 rotate at different circumferential speeds.

In addition, while the process of restoring the surface of fixing belt 61 is executed at the time when the width of sheet S which passes through fixing nip NP is increased from a present moment in the above-mentioned embodiment, the present invention is not limited thereto. For example, the process of restoring the surface of fixing belt 61 may be automatically performed at the time when operation section 22 receives execution of the surface restoration process from the user, or when the image formation process of a printing job is terminated.

In addition, in the above-mentioned embodiment, the user may change the period for which fixing belt 61 and lower pressure roller 65 are rotationally driven and the predetermined temperature of fixing belt 61, as the conditions under which the surface restoration process is performed. For example, the period for which fixing belt 61 and lower pressure roller 65 are rotationally driven and the predetermined temperature of fixing belt 61 may be arbitrarily selected by the user from among the following conditions (1) to (3).

6 [min],160[° C.] (1)

3 [min],180[° C.] (2)

2 [min],200[° C.] (3)

In addition, in the above-mentioned embodiment, when fixing belt 61 and lower pressure roller 65 are rotated at different circumferential speeds, the braking torque for limiting the magnitude of the following rotation of fixing belt 61 may be controlled on the basis of results of measurement of the circumferential speed of fixing belt 61. To be more specific, when the circumferential speed of fixing belt 61 is lower than the desired circumferential speed (when the circumferential speed difference is great), the circumferential speed of fixing belt 61 is increased by decreasing the magnitude of the braking torque. On the other hand, when the circumferential speed of fixing belt 61 is higher than the desired circumferential speed (when the circumferential speed difference is small), the circumferential speed of fixing belt 61 is decreased by increasing the magnitude of the braking torque. For the measurement of the circumferential speed of fixing belt 61, an encoder may be used to measure the rotational frequency of upper pressure roller 63, and a laser Doppler speedometer may be used to measure the surface velocity of fixing belt 61.

In addition, in the above-mentioned embodiment, when fixing belt 61 and lower pressure roller 65 are rotated at different circumferential speeds, the fixing nip width may be controlled such that the circumferential speed difference between fixing belt 61 and lower pressure roller 65 is equal to a predetermined circumferential speed difference. To be more specific, when the circumferential speed difference between fixing belt 61 and lower pressure roller 65 is greater than the predetermined circumferential speed difference, the fixing nip width is increased to establish the state where fixing belt 61 and lower pressure roller 65 do not smoothly slip on each other, thereby decreasing the circumferential speed difference. On the other hand, when the circumferential speed difference between fixing belt 61 and lower pressure roller 65 is smaller than the predetermined circumferential speed difference, the fixing nip width is decreased to establish the state where fixing belt 61 and lower pressure roller 65 smoothly slip on each other, thereby increasing the circumferential speed difference.

Example

Finally, results of experiments conducted by the present inventor to confirm the effectiveness of the above-mentioned embodiment will be described.

[Configuration of Image Forming Apparatus According to Example]

For the experiment, image forming apparatus 100 having the configuration illustrated in FIGS. 1 to 3 was used.

[First Experiment Method]

In the first experiment, a thick sheet or sheet S having a rough surface was passed through fixing nip NP having a fixing nip width of 23 [mm] to form a sheet-edge mark on the surface of fixing belt 61. Thereafter, the fixing nip width of fixing nip NP was set to each of values of 6 to 12 [mm] when performing a process of restoring the surface of fixing belt 61, and lower pressure roller 65 was rotationally driven. With lower pressure roller 65 rotationally driven, braking torque (constant value) for limiting the following rotation of upper pressure roller 63 and fixing belt 61 was generated. As the fixing nip width increases, the slipping between fixing belt 61 and lower pressure roller 65 become more difficult, and accordingly the circumferential speed difference decreases. FIG. 5 shows evaluations on the surface restoration of fixing belt 61 and the rotation of fixing belt 61 and lower pressure roller 65 on the basis of the following evaluation criteria.

(Surface Restoration of Fixing Belt 61)

A: The sheet-edge mark left on fixing belt 61 was removed.

B: The sheet-edge mark left on fixing belt 61 was not removed.

(Rotation of Fixing Belt 61 and Lower Pressure Roller 65)

A: Rotation failure of fixing belt 61 and lower pressure roller 65 was not caused.

B: Rotation failure of fixing belt 61 and lower pressure roller 65 was caused.

[First Experiment Result]

As illustrated in FIG. 5, when the fixing nip width of fixing nip NP is 8 to 11 [mm], the sheet-edge mark left on fixing belt 61 was removed. On the other hand, when the fixing nip width of fixing nip NP is 12 [mm], the sheet-edge mark left on fixing belt 61 was not removed. One possible reason for this is that the slipping between the surface of fixing belt 61 and the surface of lower pressure roller 65 became more difficult as the fixing nip width was increased, and the desired speed difference could not be provided between fixing belt 61 and lower pressure roller 65 at the time of rotationally driving fixing belt 61 and lower pressure roller 65. It can be said that the same result (the result that the sheet-edge mark is not removed) is obtained when the fixing nip width is greater than 12 [mm] On the other hand, when the fixing nip width of fixing nip NP is as small as 6 to 7 [mm], the slipping between the surface of fixing belt 61 and the surface of lower pressure roller 65 was excessive, and fixing belt 61 did not smoothly follow the rotation of lower pressure roller 65. That is, the rotation failure of fixing belt 61 and lower pressure roller 65 was caused, and fixing belt 61 and lower pressure roller 65 could not be rotationally driven with the desired speed difference therebetween. As a result, the sheet-edge mark left on fixing belt 61 was not removed. It can be said that the same result (the result that the sheet-edge mark is not removed) is obtained when the fixing nip width is smaller than 6 [mm]. As described above, when the fixing nip width is small, there is a possibility that a scratch is left on the surface of fixing belt 61, and the scratch is transferred in the fixing process, resulting in defective images. When the fixing nip width is small, decreasing the magnitude of the braking torque for limiting the following rotation of fixing belt 61 may be a possible solution to prevent the scratch from being left on the surface of fixing belt 61. The reason for this is that, by decreasing the magnitude of the braking torque, the slipping between fixing belt 61 and lower pressure roller 65 is decreased, and fixing belt 61 easily rotates to follow the rotation of lower pressure roller 65.

[Second Experiment Method]

Figure 6:
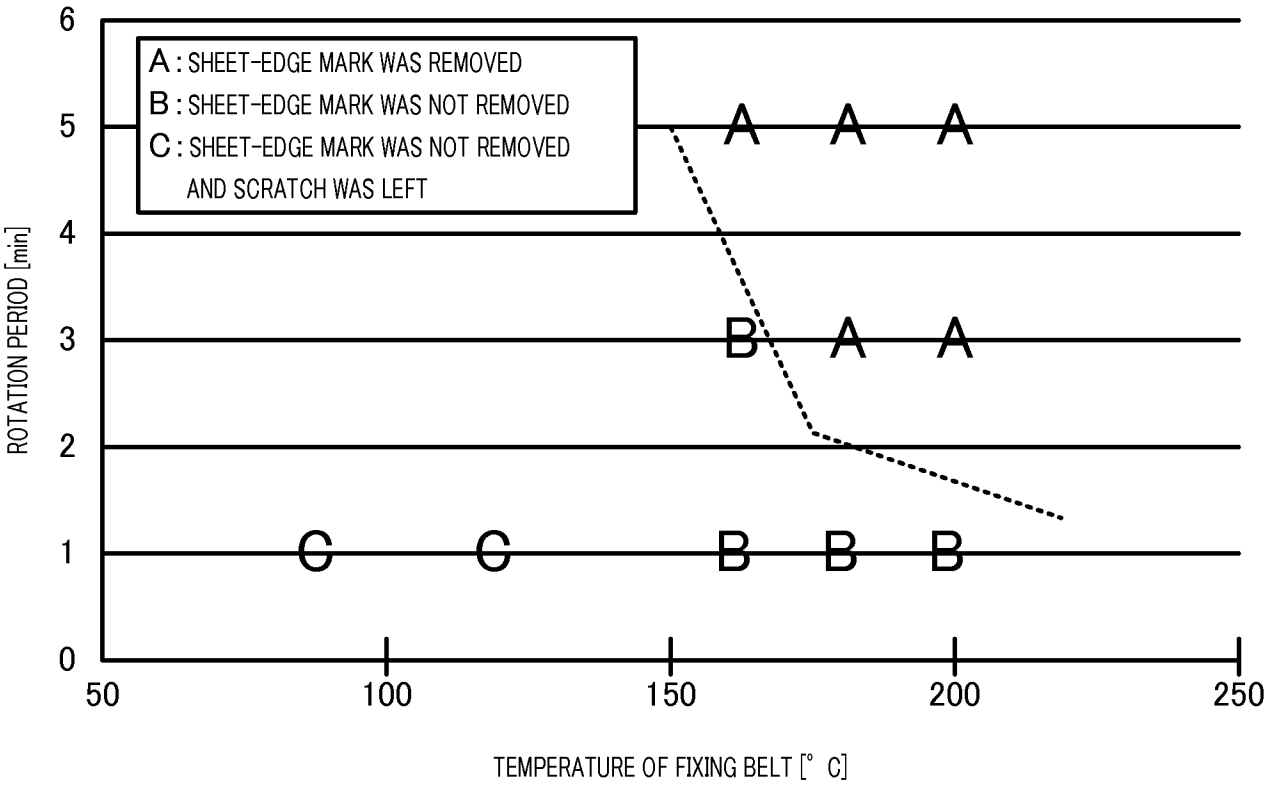
FIG. 6 illustrates a relationship between a condition for a surface restoration process and the surface restoration of the fixing belt in the embodiment.

In the second experiment, a thick sheet or sheet S having a rough surface was passed through fixing nip NP having a fixing nip width of 23 [mm] to leave a sheet-edge mark on the surface of fixing belt 61. Thereafter, the temperature of fixing belt 61 and the period for which fixing belt 61 and lower pressure roller 65 are rotated were changed as the conditions under which the process of restoring the surface of fixing belt 61 is performed. The fixing nip width was 9 [mm] and the circumferential speed difference was 4 [mm/s] in each case. FIG. 6 shows results of evaluations on the surface restoration of fixing belt 61 on the basis of the following evaluation criteria.

(Surface Restoration of Fixing Belt 61)

A: The sheet-edge mark left on fixing belt 61 was removed.

B: The sheet-edge mark left on fixing belt 61 was not removed.

C: The sheet-edge mark left on fixing belt 61 was not removed. Further, a scratch was left on the surface of fixing belt 61.

[Second Experiment Result]

As illustrated in FIG. 6, it was confirmed that, as the temperature of fixing belt 61 is increased and as the period for which fixing belt 61 and lower pressure roller 65 are rotated is prolonged, the sheet-edge mark left on fixing belt 61 is more likely to be removed. In particular, it was confirmed that the effect of removing the sheet-edge mark can be achieved when the temperature of fixing belt 61 is 180[° C.] and the period for which fixing belt 61 and lower pressure roller 65 are rotationally driven is equal to or longer than 3 [min].

What is claimed is:

1. A fixing device comprising:

a fixing side member disposed on a fixing side of a sheet on which a toner image is formed;

a back side supporting member configured to form a fixing nip for conveying the sheet in a tightly sandwiching manner in a state where the back side supporting member is brought in pressure contact with the fixing side member;

a fixing nip width changing section configured to change a fixing nip width of the fixing nip; and a control section configured to control the fixing nip width changing section such that the fixing nip width is smaller than a fixing nip width for use in a fixation, and to rotate the fixing side member and the back side supporting member at different circumferential speeds so as to restore a surface of the fixing side member, wherein the control section controls the fixing nip width such that a circumferential speed difference between the fixing side member and the back side supporting member is equal to a predetermined circumferential speed difference.

2. The fixing device according to claim 1, wherein the fixing side member rotates to follow a rotation of the back side supporting member, the fixing device further comprises a braking torque generation section configured to generate braking torque for limiting the following rotation of the fixing side member, and the control section rotationally drives the back side supporting member and controls the braking torque generation section to generate the braking torque so that the fixing side member and the back side supporting member rotate at different circumferential speeds.

3. The fixing device according to claim 1, wherein the control section sets a period for which the fixing side member and the back side supporting member are rotated on the basis of the fixing nip width.

4. The fixing device according to claim 1, wherein the control section sets a period for which the fixing side member and the back side supporting member are rotated to 1 minute to 90 minutes.

5. The fixing device according to claim 1, wherein, when a process of restoring the surface of the fixing side member is performed, the control section controls a temperature of the fixing side member at a predetermined temperature which is set in advance.

6. The fixing device according to claim 1, wherein the control section performs a process of restoring the surface of the fixing side member at a time when a width of the sheet for fixing is increased from a present moment.

7. The fixing device according to claim 1, wherein the fixing side member is a fixing belt.

8. An image forming apparatus comprising the fixing device according to claim 1.

9. A surface restoration method of restoring a surface of a fixing side member in a fixing device, the fixing device including a fixing side member disposed on a fixing side of a sheet on which a toner image is formed, and a back side supporting member configured to form a fixing nip for conveying the sheet in a tightly sandwiching manner in a state where the back side supporting member is brought in pressure contact with the fixing side member, the method comprising:

changing a fixing nip width of the fixing nip such that the fixing nip width is smaller than a fixing nip width for use in a fixation; and rotating the fixing side member and the back side supporting member at different circumferential speeds, wherein the fixing nip width is controlled such that a circumferential speed difference between the fixing side member and the back side supporting member is equal to a predetermined circumferential speed difference.

10. The surface restoration method according to claim 9, wherein the fixing side member rotates to follow a rotation of the back side supporting member, and the back side supporting member is rotationally driven and braking torque for limiting the following rotation of the fixing side member is generated so that the fixing side member and the back side supporting member rotate at different circumferential speeds.

11. The surface restoration method according to claim 9, wherein a period for which the fixing side member and the back side supporting member are rotated is set on the basis of the fixing nip width.

12. The surface restoration method according to claim 9, wherein a period for which the fixing side member and the back side supporting member are rotated is set to 1 minute to 90 minutes.

13. The surface restoration method according to claim 9, wherein, when a process of restoring the surface of the fixing side member is performed, a temperature of the fixing side member is controlled at a predetermined temperature which is set in advance.

14. The surface restoration method according to claim 9, wherein a process of restoring the surface of the fixing side member is performed at a time when a width of the sheet for fixing is increased from a present moment.

15. The surface restoration method according to claim 9, wherein the fixing side member is a fixing belt.

* * * * *